United States Patent [19]

Koch

[11] Patent Number: 4,901,767

[45] Date of Patent: Feb. 20, 1990

[54] SUPPORTING BAR OF A HEDDLE FRAME

[75] Inventor: Bernhard Koch, Horgenberg, Switzerland

[73] Assignee: Grob & Co. Aktiengesellschaft, Horgen, Switzerland

[21] Appl. No.: 264,949

[22] PCT Filed: Jan. 11, 1988

[86] PCT No.: PCT/CH88/00007

§ 371 Date: Sep. 21, 1988

§ 102(e) Date: Sep. 21, 1988

[87] PCT Pub. No.: WO88/05837

PCT Pub. Date: Aug. 11, 1988

[30] Foreign Application Priority Data

Jan. 28, 1987 [DE] Fed. Rep. of Germany ..... 3702524

[51] Int. Cl.[4] ..... D03C 9/06

[52] U.S. Cl. ..... 139/92

[58] Field of Search ..... 139/91, 92

[56] References Cited

U.S. PATENT DOCUMENTS 3,754,577 8/1973 Heller ..... 139/92

4,144,910 3/1979 Bader ..... 139/91

4,387,742 6/1983 Graf ..... 139/92

4,706,717 11/1987 Root et al. ..... 139/92

FOREIGN PATENT DOCUMENTS 60-47942 10/1983 Japan ..... 139/91

*Primary Examiner*—Andrew M. Falik

*Attorney, Agent, or Firm*—Watson, Cole, Grindle & Watson

[57] ABSTRACT

A supporting bar of a heddle frame comprises a hollow body and a connecting part (2) adjoining at a narrow side of the hollow body the support of the heddle carrying rod (3) located at its end. The supporting bar including these parts forms a welded structure comprising planar sheet metal section (4–14) forming walls of such parts. Relatively thin sheet metal section (5, 6, 9, 10) forming longitudinally extending broad side walls are welded to sheet metal sections (4, 7, 8, 11, 12) having a considerable larger material thickness and forming longitudinally extending narrow side walls. The planar sheets are welded together by the use of laser welding to form the supporting bar which has a light weight and high alternate bending strength.

8 Claims, 3 Drawing Sheets

SUPPORTING BAR OF A HEDDLE FRAME

BACKGROUND OF THE INVENTION

This invention relates to a supporting bar of a heddle frame including a frame stave and a heddle carrying rod mounted thereto.

The supporting bars of most of the presently employed heddle frames of textile machines, of which two respective ones are interconnected by lateral supports and form a frame termed heddle frame, comprise a hollow profile of light metal. According to a preferred design the heddle carrying rod is integrally mounted to the hollow profile of the frame stave, having a hollow rectangular cross-sectional profile, via an extended side wall of this hollow profile. The accordingly integral supporting bar may be produced as a drawn profile.

Presently, the longer the broader weaving machines are produced and due to technical improvements the speed of weaving machines is increased continuously such that the heddle frames which are reciprocatingly moved are subject to extremly high loadings. In order to guarantee the necessary bending resistance of the supporting bars it is accordingly necessary to select for the highly loaded heddle frames either a corresponding larger wall thickness or section, respectively for the hollow profile which leads to an increase of the weight and accordingly to an increase of the driving power, or it will be necessary to search for a different compromised solution and e.g. stiffen the light metal profile by steel inserts. Accordingly, it is known for instance to provide recesses in the edges of the light metal forming the hollow body and to insert stiffening rails of steel thereinto.

The steady increase of the loading of the heddle frames of modern weaving machines, specifically at the high speeds, necessitates, however, to account for the alternating bending strength of the material used for the heddle frames. For light metal, this alternating bending strength, drawn as a curve over a number of cycles of stress, decreases initially steeply down to a certain value and thereafter less steep, but still continuously, which does not occur for steel after reaching a certain limit value, such that for light metal due to the steadily declining curve at any given time the breakage due to increased loading can occur. This detrimentally influence the life time of the heddle frame. With regard to the alternating bending strength steel has a much better performance, however this material incorporates a high density which is a drawback for the object at hand.

SUMMARY OF THE INVENTION

It is an object of the present invention to provide a supporting bar of heddle frames made with regard to properties such as alternating bending strength, workability, etc. of the extremely suitable material such as steel, but of a light construction design which leads, regarding the weight, to a better result in comparison with a supporting bar of a light metal profile and, additionally is also realizable regarding the costs of production in relation to the final product.

The supporting bar of the invention is comprised of substantially planar combined sheet metal sections which guarantees that a supporting bar of a length of several meters and produced by combining sheet metal sections does not warp. To achieve this light structural design very thin sheets are used which allows their use on an assembling machine operating at high speeds whereby the operation suitably encompasses welding by a laser technique. To avoid bending of a long supporting bar the sheet metal sections forming the wall comprise at the longitudinal narrow sides of the frame stave a several times larger thickness of material than the sheet metal sections of the longitudinally extending broad sides of the frame stave which are welded to the narrow sides.

DETAILED DESCRIPTION OF THE INVENTION

Figure 1:
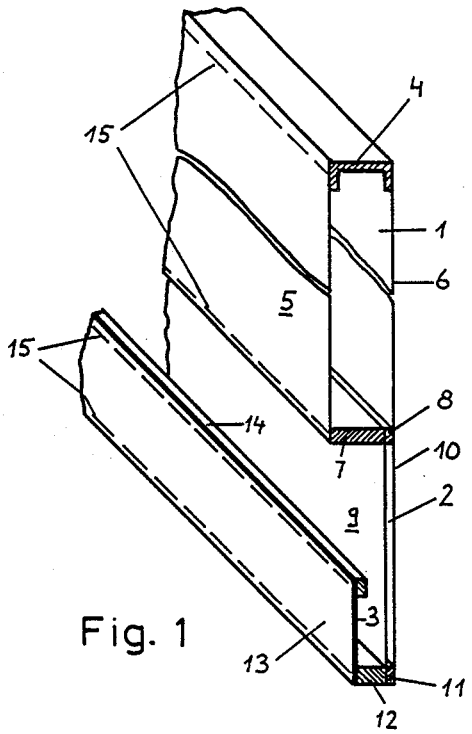
FIGS. 1–8 and 12 illustrate various embodiments of a supporting bar according to the invention in vertical section and in perspective view and partly broken away.

A supporting bar of a heddle frame is shown in FIG. 1 as including a frame stave 1 forming a hollow body, a connecting part 2 adjoining the lower end thereof and a heddle carrying rod 3 connected to the lower end of part 2. The design of the supporting bar corresponds to the design of a common light-metal profile bar. The supporting bar of the invention forms a welded structure of planar sheet metal sections of varying material thickness and respectively forming a wall, which sheet metal sections extend along the entire length of the supporting bar. The frame stave 1 is constructed by a sheet metal section 4 bent into a U-shape and forming the upper longitudinal narrow side, by a sheet metal section 5 forming a longitudinally extending broad side at the front side, by a sheet metal section 6 forming a longitudinally extending broad side at the back side, and by sheet metal sections 7 and 8 having a considerable larger thickness of material and forming the longitudinal bottom narrow side. The ledge-shaped sheet metal section 8 additionally forms the upper longitudinal narrow side of the connecting part 2 which is also designed as a hollow body comprising planar sheet metal sections which is considerably narrower than the frame stave 1. In order to make up this hollow body forming the connecting part 2 the sheet metal sections 9 and 10 which form the broad sides and feature a smaller wall thickness are welded to the ledge shaped sheet metal section 8 and also to a ledge shaped body 11 at the lower end thereof. The sheet metal section 9 having an extremely small material thickness is additionally welded to the sheet metal section 7 forming the narrow side and is welded at the bottom edge of the connecting part to a ledge shaped sheet metal section 12 which, similarly as sheet metal section 11, has a considerably higher thickness of material than the sheet metal sections 9 and 10 forming the broad sides. All sheet metal sections 4, 7, 8, 11 and 12 which form the longitudinal narrow sides and have the larger thickness of material provide for the bending resistance of the supporting bar and the feasability of welding thereto the sheet metal sections 5, 6, 9 and 10 forming the broad sides and having a substantially smaller material thickness. Such material thickness is also substantially smaller than the material thickness of the corresponding wall sections of the commonly known light-metal supporting bars. In comparison with such commonly known bars the lower weight of the supporting bar of the invention is accordingly arrived at in the final instance. The heddle carrying rod 3 is welded to the ledge shaped sheet metal section 12. The rod 3 comprises a sheet metal section 13 and a ledge shaped sheet metal section 14 welded to its upper edge. The assembling of all sheet metal sections is carried out by a laser welding procedure at the longitudinally extending broad sides. At the front side which can be seen in the drawing four weld connecting lines 15 are illustrated by broken lines. The welding is also made correspondingly at the back side.

To produce the supporting bar a corrosion proof sheet metal is used for the metal sheets and have a small wall thickness of about 0.25 millimeters. The several times larger thickness of material of the sheet metal sections at the longitudinal narrow sides is about 1 to 1.5 millimeters, i.e. a multiple of the thin sheet metal sections. This design allows for the production of extremely long supporting bars having a high bending strength and a weight which is lower than that of a supporting bar of the same length and of a common light metal profile. A material 16 is inserted into the hollow space of the frame stave 1 which fills the hollow space as a sound abating foamed material and functions as a supporting and holding body for the sheet metal sections forming the broad sides thus preventing any denting thereof towards the inside and the outside as well. This material supporting and holding the sheet metal sections at the broad sides allows for use of sheet metal sections of an extremely small wall thickness.

Figure 2:
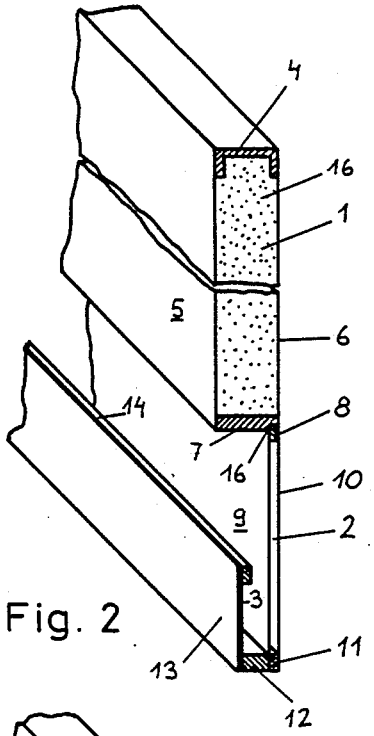

The embodiment according to FIG. 2 differs from that of FIG. 1 only with regard to the connecting zone between the frame stave 1 and the connecting part 2. The sheet metal section 7 forming the longitudinal narrow side includes a recess at a bottom longitudinal edge into which the connecting part 2 is inserted at its upper longitudinal narrow side 8. The parts of the supporting bar consisting of frame stave and connecting part 2 may be welded together with seperately pre-assembled box-like structures.

Figure 3:
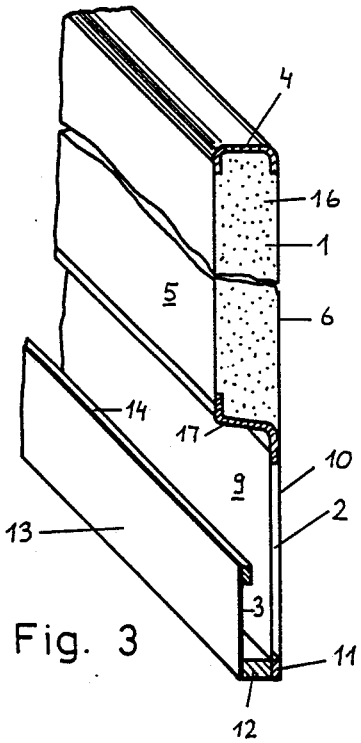

With regard to this connection between frame stave 1 and connecting part 2 FIG. 3 discloses a modified embodiment. Here, the longitudinal narrow side of the frame stave 1 is formed by a sheet metal section 17 of Z-shaped cross-section of which the one leg forms the upper longitudinal narrow side of the connecting part 2 having the shape of a hollow body whereby the sheet metal sections 9 and 10 are welded onto said leg. The section 17 is, furthermore arranged such that the central portion thereof which interconnects its two legs is inclined at an angle of 6° forwardly and upwardly such that threaded bolts not, for instance for supporting members for struts or similar members which extend from the bottom into the frame stave, are more easily accessible. The heddle carrying rod 3 impedes the operating of such threaded bolts if they extend vertically upwards into the frame stave.

Figure 4:
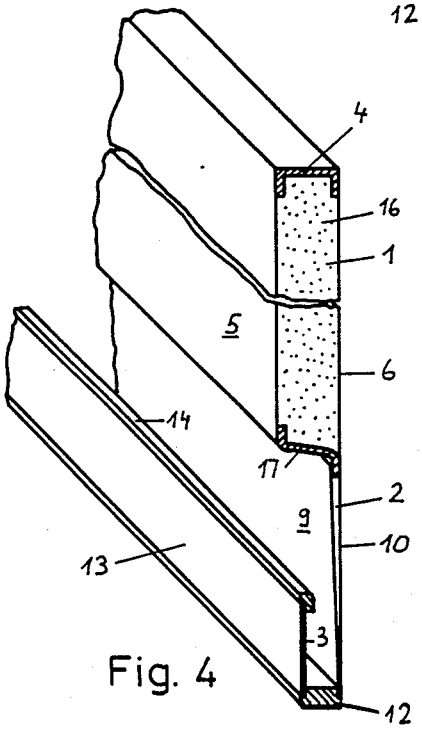

According to FIG. 4 the connecting part 2 can be designed in accordance with a further modified embodiment also tapering towards the bottom such that in this embodiment the two sheet metal sections 9 and 10 are directly welded to each other at the bottom.

Figure 5:
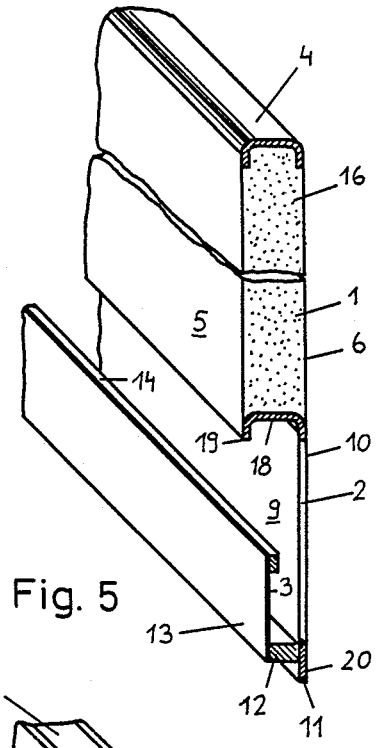

According to FIG. 5 the bottom longitudinal narrow side of the frame stave is formed by a sheet metal section 18 of U-shaped cross-section. The connecting part 2 is welded by its two sheet metal sections 9 and 10 onto one leg of section 18. The other leg of section 18 forms a so-called supporting lug 19 at the front side allowing a mounting of plug-on guides, supporting members or driving members (not shown) which are mounted by embracing the frame stave such as commonly known for supporting bars consisting of a light metal profile. In a corresponding manner it is also possible to form a supporting lug 20 at the lower edge of the connecting part 2 by a corresponding dimensioning of the bottom ledge shaped longitudinal narrow side 11 of the connecting part.

Figure 6:
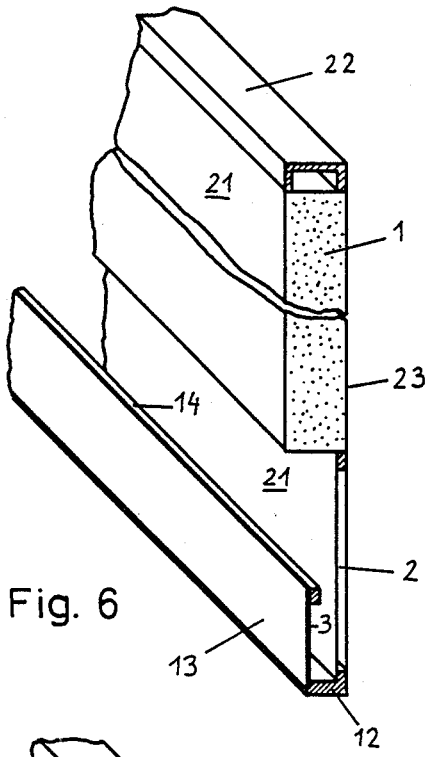

According to FIG. 6, the number of the sheet metal sections which form the supporting is reduced in that a multiple angled integral sheet metal section 21 is used for the front side of the supporting bar which encompasses the two longitudinal narrow sides of the frame stave 1 and the broad side of the frame stave as well as the front broad side of the connecting part 2. The reinforcement for providing the bending strength is effected by a sheet metal section 22 of U-shaped cross-section located on the top and welded in place. The modified embodiment according to FIG. 6 can also be formed at the rear side such that the frame stave 1 and the connecting part 2 include a planar sheet metal section 23 extending integrally along the entire height of the supporting bar and forming a common broad side extending in the longitudinal direction. This back side extending integrally over the entire supporting bar can also be effected for each of the embodiments according to FIGS. 1 to 5.

Figure 7:
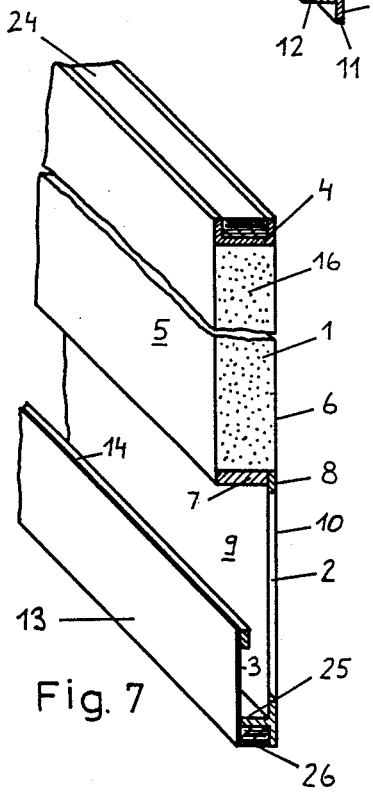

The FIG. 7 deviates from the embodiment according to FIG. 1 in that a reversely oriented sheet metal section 4 of U-shaped cross-section is located at the upper longitudinal narrow side such that both its legs extend upwardly. The longitudinal groove between these two legs is filled by a fiber composite material 24, specifically a material comprising graphite fiber having a weight five times lower than that of steel. An extremely high bending strength is arrived at with the use of this material, and it is possible to select a U-profile 4 having a still smaller wall thickness. At the bottom longitudinal edge of the supporting bar a longitudinal groove is formed between the connecting part 2 and the heddle carrying rod 3 by the provision of a sheet metal section 25 of T-shaped cross-section interconnecting these two parts, the groove thereby formed being filled by a composite fibre material 26.

Figure 8:
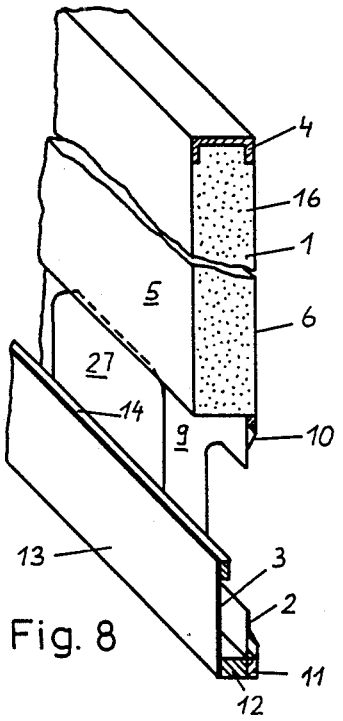
Figure 9:
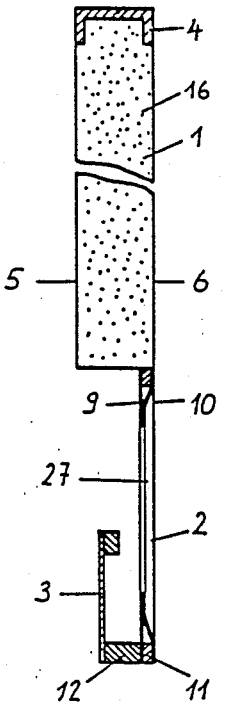
FIGS. 9, 10 and 11 illustrate a vertical section through various embodiments of the supporting bar of FIG. 8.
Figure 10:
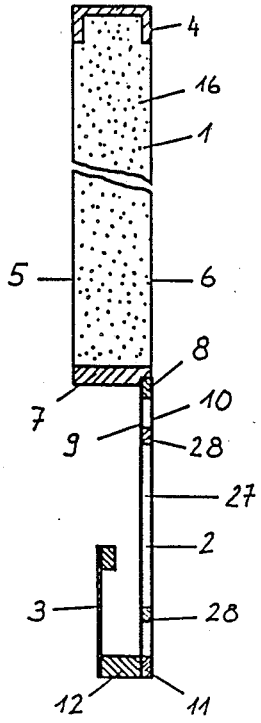
Figure 11:
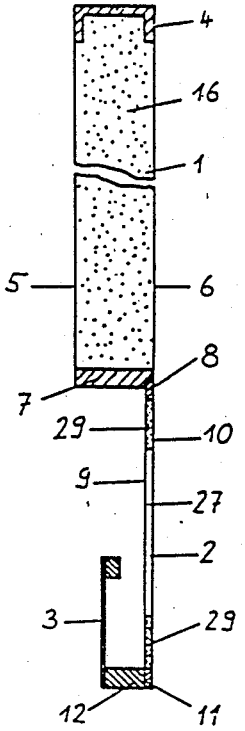

To obtain a reduced weight recesses 27 are formed at the supporting bar according to FIG. 8 in the connecting part 2 at regular intervals which, apart from reducing the weight, function also to prevent dust form accummulating between the heddle carrying rod and the connecting part. These recesses 27 may be suitably provided in all embodiments according to FIGS. 1 to 7. These recesses are also provided for a supporting bars consisting of a light metal profile. In the design of the supporting bar consisting of individual sheet metal sections as presently disclosed the resesses 27 can be produced by various procedures. The sections through the supporting bar according to FIGS. 9, 10 and 11 illustrate three alternate embodiments of the recess which have been produced by different procedures. According to FIG. 9 the rear sheet metal section 10 has been deformed by a deep drawing after the pre-punching of the recess 27 such that it abuts the forward sheet metal section 9 along the edge of the recess. Thereafter, the two sheet metal sections are interconnected by a laser welding procedure. And, a final working of the edge of the recess is then made.

According to FIG. 10 the recess 27 is made such in that the forward and also rearward sheet metal sections 9 ad 10 are punched out and that the rearward sheet metal section 10 is placed onto a mandrel having a size corresponding to a cross-section of the recess, and thereafter a covering 28 in form of a hoop is placed on such mandrel. Thereafter, the forward sheet metal section 9 is placed on the same mandrel and finally the two sheet metal sections 9 and 10 and the covering 28 are welded together. The intent of this measure is to prevent dust from accummulating in the space between the forward and rearward sheet metal sections.

In order to reach the same result a further method consists in a filling the space of a supporting bar according to FIG. 11 between the forward sheet metal section 9 and the rearward sheet metal section 10 by a hard foam 29. In place thereof a glass-fiber reinforced hard foam in the form of a plate including a recess formed therein may be inserted between the two sheet metal section at this area.

Figure 12:
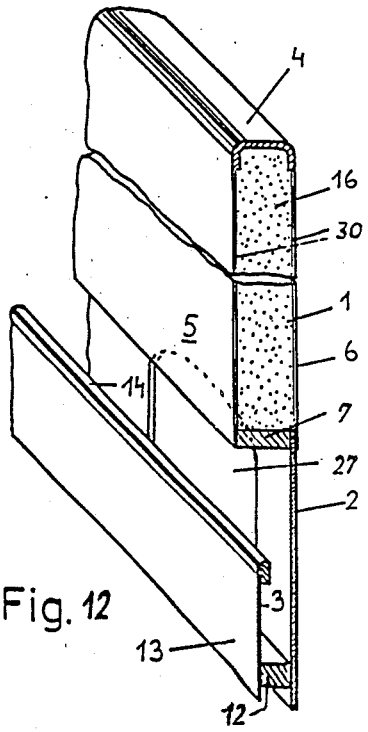

To maintain the expenditures for the production of the recess 27 in the connecting part 2 as low as possible a specifically preferred embodiment in accordance with FIG. 12 includes a connecting part 2 made of an integral strip-like sheet metal section which has a considerably higher material thickness than the sheet metal sections 5 and 6 of the longitudinal extending broad sides of the frame stave 1. This connecting part 2 is mounted to the sheet metal section 7 forming the longitudinal narrow side of the frame stave, whereby the sheet metal section 6 forming the broad side of the frame stave is welded to the connecting part 2 and latter onto the sheet metal section 7 by means of a laser weld seam carried out by a laser welding technique due to the small wall thicknesses. Furthermore, the connecting part 2 is weld connected to the parallel extending heddle carrying rod 3 via a profile rod 12 located between the heddle carrying rod and the connecting part. In this simpler embodiment, furthermore, the number of sheet metal parts to be welded together is reduced in comparison with the previously described embodiments.

The supporting bar according to FIG. 12 includes further a thin, elastomeric intermediate layer 30 located between the longitudinally extending broad sides 5 and 6 of sheet metal, and the sound abating material 16 filling its hollow space to which layer 30 is connected adheres to the sheet metal and to the sound abating material. This intermediate layer having a thickness of only about 0.3 millimeters prevents rupturing of the core consisting preferably of hard foam at its border layer at the sheet metal due to the extremely high loading by the rapid upward and downward movement of the supporting bar. Obviously, this elastomeric intermediate layer 30 may be provided in all previously described embodiments according to FIGS. 1–11.

The above described supporting bar of assembled sheet metal sections posesses advantages in addition to high alternate bending strength and comparably lighter weight than a supporting bar consisting of a light metal profile. Accordingly, it is for instance possible to weld threaded bushes at the necessary areas to the inner side of the longitudinal narrow side such as to mount e.g. the driving notched bar for the heddle frame. In relation to a solid material of light weight metal for the placing of threaded bores in common light metal supporting bars, threaded bushes having a small lateral extent placed at the previously exactly measured point are sufficient which again adds to reduction of the total weight. The same is true for the threaded units located at the ends and used for the threaded mounting of the lateral supports from which heddle frame is made together with two supporting bars.

I claim:

1. In a heddle frame assembly for a loom of the type which includes upper and lower supporting bars vertically spaced by side frame members, said supporting bar comprising a frame stave and a heddle carrying rod and a connecting part for connecting said carrying rod to said frame stave to extend at a distance parallel to said frame stave, said frame stave forming a hollow body and having longitudinal narrow sides and broad sides and a substantially rectangular outer cross-section wherein said frame stave, said connecting part and said heddle carrying rod comprise sheet metal sections and form a welded structure, said longitudinal broad sides of said frame stave comprising thin sheet metal sections welded to said frame stave narrow sides, said narrow sides having a material thickness several times greater than that of said broad sides, said connecting part being welded to one of said frame stave narrow sides, and the heddle carrying rod being welded to said connecting part via a rod located between said connecting part and said heddle carrying rod.

2. Supporting bar according to claim 1, wherein the connecting part comprises a hollow body having a cross-sectional width which is substantially less than the width of said frame stave and wherein the sheet metal sections forming the longitudinal narrow sides of said connecting part are of a material thickness several times greater than that of the sheet metal sections of the longitudinal broad sides welded to said longitudinal narrow sides.

3. Supporting bar according to claim 2, wherein the connecting part has weight reducing recesses located at longitudinal intervals therealong, and the connecting part comprising a pair of spaced sheet metal sections forming a hollow body, a covering connected to at least one of said sections for closing off the recesses for preventing dust from entering.

4. Supporting bar according to claim 1, wherein one of the longitudinal narrow sides of said frame stave faces said connecting part and comprises an angled sheet metal section of U-shaped or Z-shaped cross-section, one leg of said angled section forming a longitudinal narrow side of the connecting part.

5. Supporting bar according to claim 1, wherein the longitudinally extending broad sides of said frame stave are parallel, and said hollow body contains a sound abating material of a hard foam for supporting and holding said body and for completely filling the hollow body of the frame stave.

6. Supporting bar according to claim 5, wherein an elastomeric intermediate layer is located between the longitudinally extending broad sides of the frame stave, and sound abating material completely fills said hollow body and is connected to said sound abating material and to said broad sides.

7. Supporting bar according to claim 1, wherein said connecting part comprises an integral strip shaped sheet metal section of material several times thicker than that of the sheet metal sections of the longitudinally extending broad sides of the frame stave.

8. Supporting bar according to claim 7, wherein said strip shaped sheet metal section has weight reducing recesses located at regular longitudinal intervals along said connecting part.

* * * * *